United States Patent [19]

Smith

[11] 3,991,466

[45] Nov. 16, 1976

[54] DUAL PURPOSE SPOON AND OYSTER KNIFE

[75] Inventor: Howard H. Smith, Montreal, Canada

[73] Assignee: The Raymond Lee Organization, Inc., New York, N.Y. ; a part interest

[22] Filed: Feb. 9, 1976

[21] Appl. No.: 656,655

[52] U.S. Cl. ..... 30/149; 17/75; D7/99

[51] Int. Cl.[2] ..... B26B 11/00; A22C 29/00

[58] Field of Search ..... 30/144, 147, 149, 120.1; 17/71, 74–75; D7/99, 106, 147, 148, 150, 152

[56] References Cited

UNITED STATES PATENTS

| | | | |
|---|---|---|---|
| 174,241 | 2/1876 | Higgens | 30/149 |
| 2,854,688 | 10/1958 | Colangelo | 17/75 |
| 3,121,951 | 2/1964 | Green | 30/149 |
| D229,739 | 1/1974 | Briddell | D7/106 |

FOREIGN PATENTS OR APPLICATIONS

| | | | |
|---|---|---|---|
| 1,304,167 | 10/1962 | France | 30/147 |

*Primary Examiner*—Al Lawrence Smith
*Assistant Examiner*—J. C. Peters
*Attorney, Agent, or Firm*—Howard I. Podell

[57] ABSTRACT

A utensil for opening an oyster which also serves to cut the oyster umbilical cord and lift the oyster out of its shell. The utensil is fitted with a handle to which the blade is fixed, with the blade being formed of metal, preferably stainless steel. The blade is shaped with a curved spoon section serrated at opposed sides of the spoon for the severing of the oyster umbilical cord, with a knife section projecting along the axis of the blade, from the spoon.

4 Claims, 2 Drawing Figures

DUAL PURPOSE SPOON AND OYSTER KNIFE

SUMMARY OF THE INVENTION

My invention is a utensil for opening an oyster which also serves to cut the oyster umbilical cord and lift the oyster out of its shell. The utensil is fitted with a handle to which the blade is fixed, with the blade being formed of metal, preferably stainless steel. The blade is shaped with a curved spoon section serrated at opposed sides of the spoon for the severing of the oyster umbilical cord, with a knife section projecting along the axis of the blade, from the spoon.

The advantage of this utensil is that it enables a user to open an oyster, remove it from the shell and either eat the oyster directly out of the spoon or transfer it in the spoon to some further location for preparation or storage.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
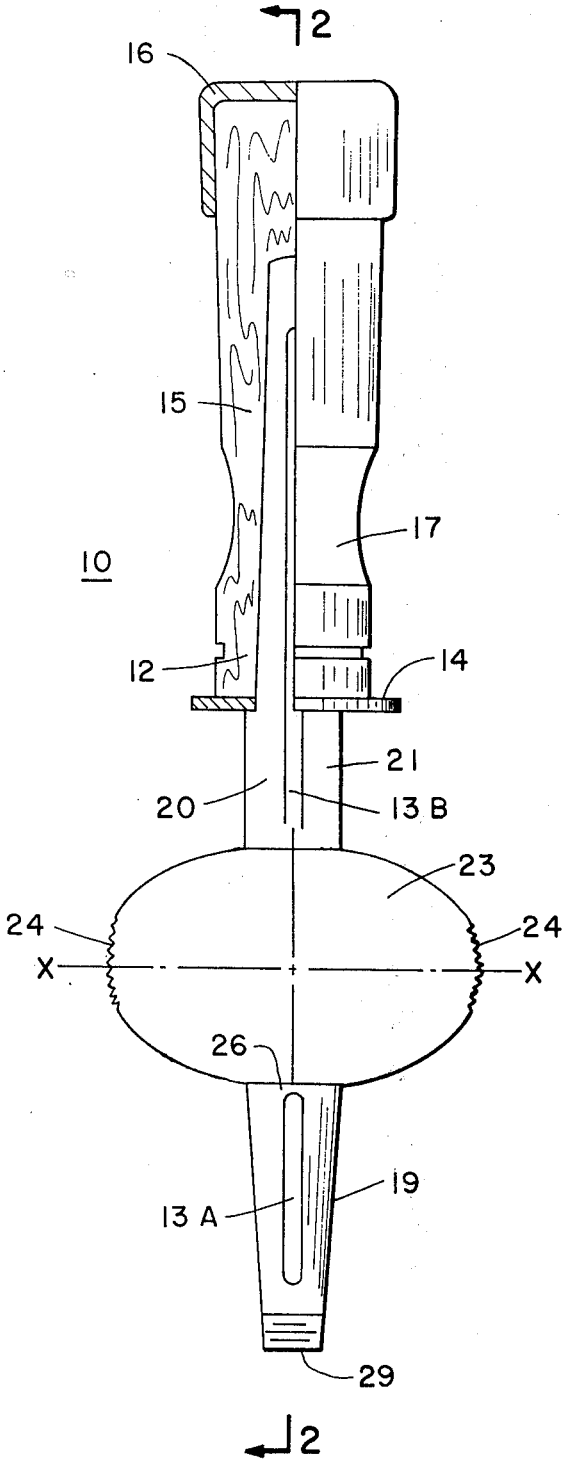
FIG. 1 is a plan view of the invention.

Turning now descriptively to the drawings, in which similar reference characters denote similar elements throughout the several views, FIG. 1 illustrates the utensil 10 which is formed of a blade member 20 fixed to a handle 15. The handle 15 is formed as a shaped cylindrical section fitted with a projecting circular flange 14 at the end 12 of the handle adjoining the blade member 20 and fitted with an end cap 16 covering the free end of the handle 15. A concave groove 17 is formed in the exterior surface of the handle to provide a grip surface.

The blade member 20 extends from the center of one end 12 of the handle 15 along the handle axis with a shank section 21 extending from inside the handle 15 to a spoon section 23 formed in the blade member 20 at a distance from the handle 15.

Figure 2:
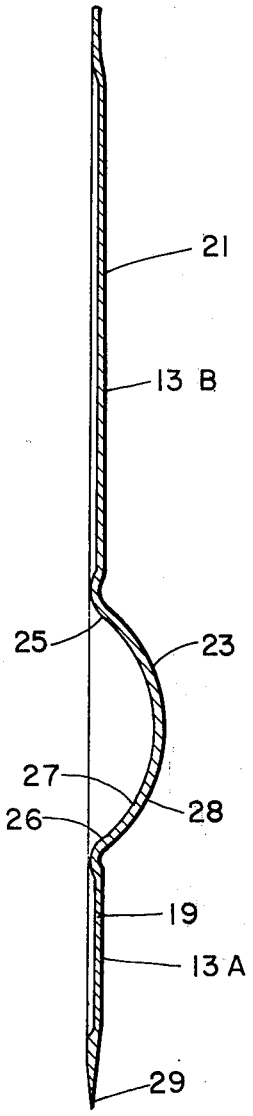
FIG. 2 is a sectional view of the blade of the tool, taken along line 2—2 of FIG. 1.

As shown in FIGS. 1–2, spoon section 23 is formed as a generally oval and spherically shaped disc with the long axis of the spoon oval *x—x* being perpendicular to the blade axis 2–2. The spoon section is formed of a generally uniform thickness of metal with the upper surface 27 curved as a concave recess and the lower surface 28 curved as a convex recess.

The opposed side edges of the spoon section 23 are formed with serrated teeth 24 for use in severing the umbilical cord of an opened oyster.

A blade section 19 extends from the spoon section 23 along the axis 2—2 of the blade, said blade section 19 extending from the end 26 of the spoon section opposed to the end 25 of the spoon section which joins the blade shank 21 leading to the handle 15. The free end 29 of the blade section 19 is formed as a knife edge, oriented perpendicularly to the axis 2—2 of the blade 20 and serves to cut into and pry the halves of the oyster shells apart.

Shaped ribs 13A and 13B are formed in the blade section 19 and shank section 21 along the axis of the blade member 20 to serve as reinforcement means. The blade member 20 is preferably formed of a metal such as a stainless steel or other non-corrosive metal alloy.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A utensil for opening the shell of an oyster, cutting the oyster from attachment to the shell, and lifting the oyster out of the shell, comprising a blade member fixed to a handle member, said blade member formed with a spoon-shaped section joined at one end to a shank section that terminates as a knife edge and joined at its opposed end to a shank section fixed to the handle member, with an edge of a side section of the spoon-shaped section formed with serrated teeth.

2. The combination as recited in claim 1 in which the edges of both opposed side sections of the spoon-shaped section are formed with serrated teeth.

3. The combination as recited in claim 1 in which the spoon-shaped section is of a generally oval outline.

4. The combination as recited in claim 3 in which the long axis of the oval outline of the spoon-shaped section is perpendicular to the axis of the blade member running from the knife edge of the blade member to the tool handle.

* * * * *